United States Patent [19]

Tjumanok et al.

[11] Patent Number: 4,653,700

[45] Date of Patent: Mar. 31, 1987

[54] DISINTEGRATOR

[75] Inventors: Alexei N. Tjumanok; Yaan V. Tamm; Jury L. Sarandi, all of Tallin, U.S.S.R.

[73] Assignee: Tallinsky Politekhnichesky Institut, Tallin, U.S.S.R.

[21] Appl. No.: 768,485

[22] PCT Filed: Nov. 11, 1984

[86] PCT No.: PCT/SU84/00060

§ 371 Date: Jul. 23, 1985

§ 102(e) Date: Jul. 23, 1985

[87] PCT Pub. No.: WO85/02354

PCT Pub. Date: Jun. 6, 1985

[30] Foreign Application Priority Data

Nov. 25, 1983 [SU] U.S.S.R. ..... 2690204

[51] Int. Cl.[4] ..... B02C 13/286

[52] U.S. Cl. ..... 241/79.1; 241/80; 241/91; 241/186.3; 241/188 R

[58] Field of Search ..... 241/188 A, 186.1, 188 R, 241/186.2, 189 R, 186.3, 186 R, 80, 97, 285 R, 285 A, 79.1, 285 B, 187, 91

[56] References Cited

U.S. PATENT DOCUMENTS 1,959,465 5/1934 Dryfoos ..... 241/186.3 X
3,711,734 1/1973 Yamazaki et al. ..... 313/174
3,771,734 11/1973 Stephenson et al. ..... 241/187
3,894,695 7/1975 Benedikter ..... 241/55

FOREIGN PATENT DOCUMENTS 943319 12/1963 United Kingdom .
261160 1/1970 U.S.S.R. .
467765 4/1975 U.S.S.R. .
528118 9/1976 U.S.S.R. .
541497 1/1977 U.S.S.R. .
938236 6/1982 U.S.S.R. .

*Primary Examiner*—Mark Rosenbaum
*Attorney, Agent, or Firm*—Fleit, Jacobson, Cohn & Price

[57] ABSTRACT

A disintegrator includes a grinding chamber (1) accommodating grinding rotors. The housing of the chamber (1) includes a cylindrical portion (7) having an outlet pipe (19) for evacuating the material and two side walls (9 and 10) one of which, particularly wall (9) has a feeding pipe (12). The cylindrical portion (7) can be turned relative to the side walls (9 and 10) the desired position being fixed by locking assemblies (11) arranged about the periphery of the cylindrical portion (7). Each locking assembly (11) includes a pressure plate (13). One end of the pressure plate (13) bears on a projection (15) provided on one of the side walls (10), whereas the other end is received by an annular groove (16) made on the outer surface of the cylindrical portion (7) of the housing. In addition, the plate (13) is secured to the side wall (10)having the projection (15) by a bolt (14).

1 Claim, 5 Drawing Figures

DISINTEGRATOR

FIELD OF THE INVENTION

The present invention relates to material crushing or grinding, and more particularly to a disintegrator.

BACKGROUND OF THE INVENTION

There are known disintegrators (cf., USSR Inventor's Certificate No. 541,497, IPC B 02 C 13/10; U.S. Pat. Nos. 3,771,734, Cl. 241-187, 3,894,695, Cl. 241-55, and British Patent No. 943,319, Cl. B 2A) comprising a housing and grinding rotors inside the housing. The housing has side walls and a cylindrical part making a one-piece construction with one side wall, the other wall being movable. The bottom portion of the cylinder has an outlet pipe, whereas the side wall has an inlet pipe. During operation the ground material is dicharged from the outlet pipe fixed in a structurally predetermined position.

There is also known a grinding apparatus (cf., USSR Inventor's Certificate No. 528,118, IPC B 02 C 21/00) comprising a housing accommodating a rotor with beaters and a separator. The housing includes a cylindrical part and two side walls. The cylindrical part has an inlet pipe and a vertically arranged pipe for evacuating the ground material to the separator. The apparatus can be used only for separation grinding. It needs modifications to carry out once-through grinding.

There is further known a disintegrator (cf., USSR Inventor's Certificate No. 541,497, IPC B 02 C 13/10) which comprises a grinding chamber accommodating rotors with grinding wheels. The housing of the chamber includes a cylindrical part having a pipe for evacuating the material from the grinding chamber and two side walls on one of which there is secured a pipe for charging the material to be ground into the grinding chamber. The cylindrical part of the housing is rigidly connected to one side wall to form an integral arrangement.

The material to be ground is fed to the grinding chamber through the charging pipe to be admitted to the first grinding wheel of the first rotor, and thereafter successively to the rest of the grinding wheels. The material is then thrown away from the rotors toward the inside surface of the cylindrical part of the housing to form a layer of such material sliding down to the outlet pipe to be evacuated from the grinding chamber.

This known disintegrator carries out once-through grinding and the material being ground is discharged from the bottom portion of the housing. In order to effect recycle operation, or to provide separation grinding, it is necessary to make use of auxiliary conveying means to return the material for repeated grinding to crush coarse fraction and collect fine fraction. A switchover from the once-through grinding to recycle grinding is therefore impossible.

SUMMARY OF THE INVENTION

The present invention is aimed at the provision of a disintegrator having a grinding chamber housing of such a construction as to ensure expansion in functional capabilities by making it possible for the disintegrator to operate under various grinding operation modes.

The aims of the invention are attained by that in a disintegrator comprising a grinding chamber accommodating grinding rotors, the housing of the chamber including a cylindrical portion with an outlet pipe for evacuating the material from the grinding chamber, and two side walls, one of which walls has secured thereto a pipe for charging the initial material to the grinding chamber, according to the invention, the cylindrical portion of the housing of the grinding chamber can be turned relative to the side walls and locked in a predetermined position by locking means arranged about the periphery of the cylindrical portion of the housing and comprising a pressure plate secured on one of the side walls of the housing by a bolt, one end of the pressure plate bearing on a projection provided on the respective wall of the housing, whereas the other end is received by an annular groove made on the outer surface of the cylindrical portion of the housing of the grinding chamber.

The proposed invention enables to make a switchover of the disintegrator from one grinding operation mode to a different operation mode swiftly and with low amount of labour consumed.

BRIEF DESCRIPTION OF THE DRAWINGS

The invention will now be described in greater detail with reference to various specific embodiments thereof taken in conjunction with the accompaying drawings, in which.

BEST MODE OF CARRYING OUT THE INVENTION

Figure 1:
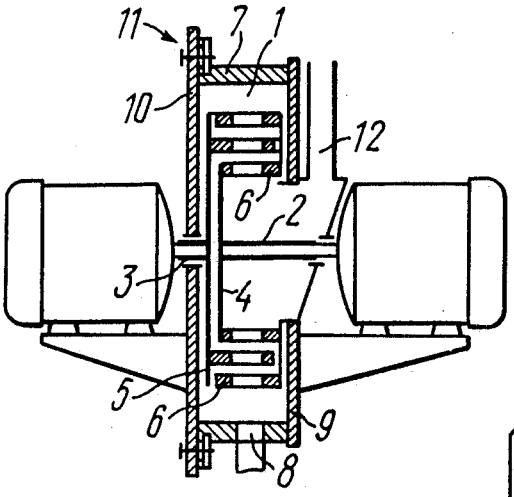
FIG. 1 is a sectional view of a disintegrator according to the invention where the material is discharged at the bottom of the housing.

A disintegrator comprises a grinding chamber 1 (FIG. 1) accommodating grinding rotors. The rotors revolve on drive shafts 2 and 3 and comprise carrying disks 4 and 5 on which grinding wheels 6 are secured.

The housing of the grinding chamber 1 includes a cylindrical part 7 having an outlet hole 8 and side walls 9 and 10, this cylindrical portion 7 being capable of turning relative to the side walls 9 and 10. A locking arrangement 11 is provided for fixing the preselected position of the cylindrical portion 7 relative to the side walls 9 and 10.

A pipe 12 is further provided for charging the material into the grinding chamber.

Figure 2:
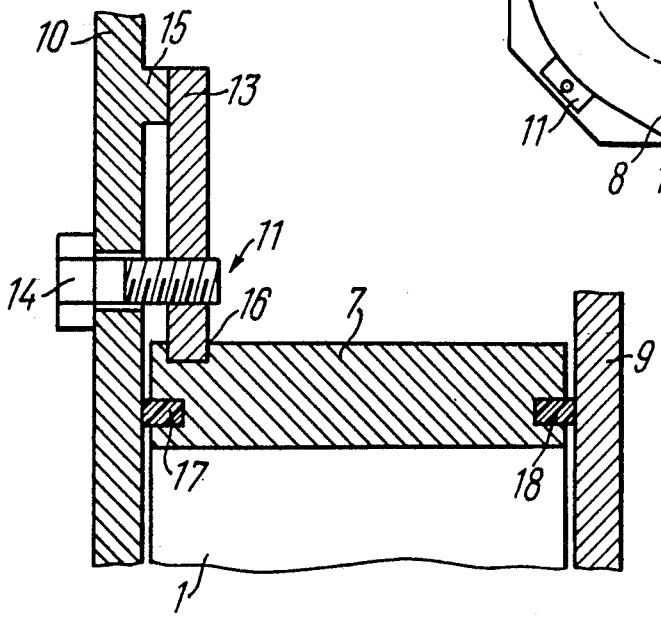
FIG. 2 is a cross-section of the housing of the grinding chamber.

The locking arrangement 11 (FIG. 2) has a pressure plate 13 secured on the side wall 10 of the housing of the grinding chamber 1 by a bolt 14. One end of the plate 13 bears on a projection 15 provided on the side wall 10, whereas the other end thereof is received by an annular groove 16 made on the outer surface of the cylindrical portion 7 of the housing. Seals 17 and 18 serve to make the grinding chamber air-tight.

For once-through grinding the outlet hole 8 (FIGS. 3 and 4) is connected by way of an outlet pipe 19 to a unit for admitting the material. This unit comprises a cyclone 20, a conduit 21 for feeding air, and a receiver 22. Depending on the position of the receiver 22, the outlet hole 8 assumes various positions relative to the side walls 9 and 10 by virtue of turning the cylindrical portion 7. A hopper 23 provided with a metering device 24 is arranged above the pipe 12.

Figure 5:
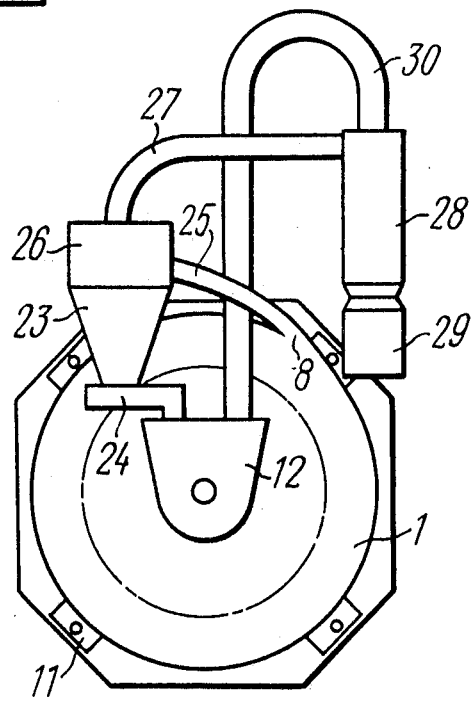
FIG. 5 is a general view of the proposed disintegrator operating in a separation grinding mode.

When the disintegrator is used for recycle operation, that is during separation grinding, the outlet hole 8 (FIG. 5) is connected by way of a constant-sign curvature conduit 25 to a separator 26 which has an air outlet 27 to a fine fraction separator. The separator 26 includes a cyclone 28, a receiver 29 of the finished product, and a conduit 30 for recycling air hermetically connected to the pipe 12.

Figure 3:
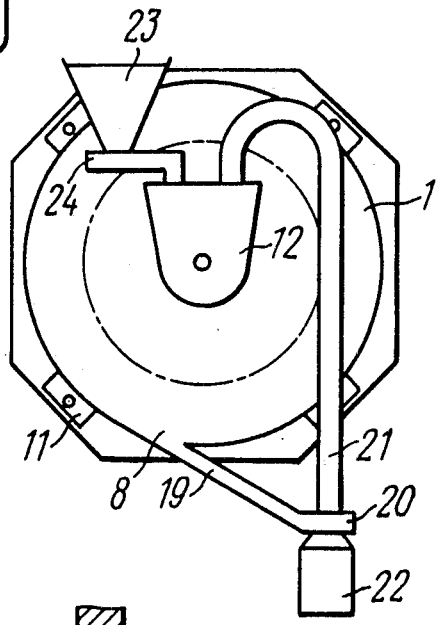
FIG. 3 is a view of the proposed disintegrator operating when once-through grinding with the material being discharged from the bottom of the housing.
Figure 4:
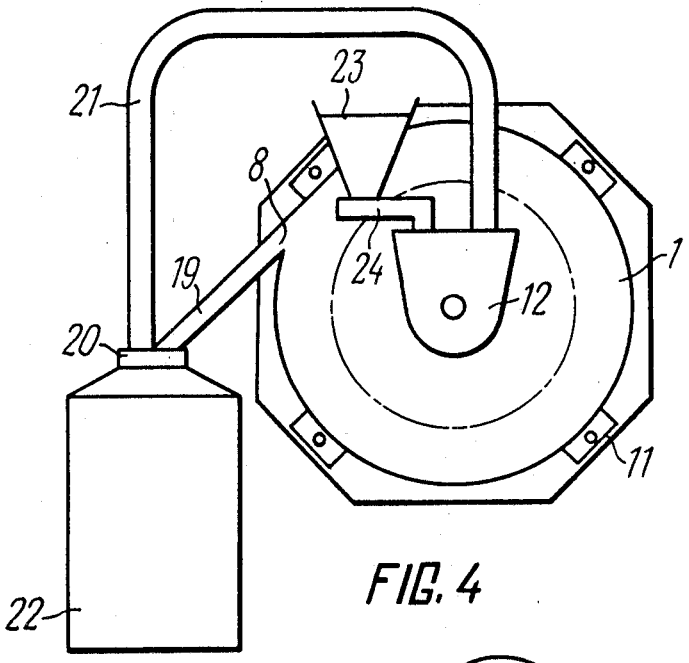
FIG. 4 is a view of the proposed disintegrator operating when once-through grinding and featuring sideways discharge of the material.

The proposed disintegrator operates in the following manner. The starting material is fed from the hopper 23 (FIG. 3) through the metering device 24 to the pipe 12 to thereafter be admitted to the grinding chamber 1 in which this material is ground. The material subjected to grinding is thrown toward the cylindrical portion 7 (FIG. 1) to slide therealong until the outlet hole 8 and be evacuated from the housing together with air. Depending on the operating conditions of the disintegrator, the material can be discharged in any direction by turning the cylindrical portion 7 of the housing. FIGS. 3 and 4 illustrate two alternative positions of the outlet pipe 19 during once-through grinding. The material is directed to the admission unit having the form of a separator, wherefrom the ground material is conveyed to the receiver 22. Air flows along the conduit 21 to the pipe 12. Once-through grinding produces material of varying grain size; in other words, the end material contains both fine and coarse fractions obtained due to crushing of the particles of the material as a result of their collisions with the grinding elements of the grinding wheels 6 (FIG. 1).

By changing the position of the cylindrical portion 7 of the housing relative to the side walls 9 and 10 it is possible to discharge the material either to the hopper 23, or to a conveyer belt, or to any other required location.

The proposed disintegrator can carry out separation grinding. In order to effect such a grinding, the cylindrical portion 7 of the housing is turned to a position in which the outlet pipe 19 (FIG. 5) communicates with the separator 26. The fine fraction of the material is conveyed with air along the air outlet 27 to the cyclone 28. From the cyclone 28 the fine fraction is conveyed to the receiver 29, whereas air flows along the conduit 30 to the pipe 12. Coarse fraction is conveyed from the separator 26 to the hopper 23 to be thereafter admitted to the disintegrator for re-grinding.

Separation grinding is preferable when it is necessary to obtain a product of narrow size grading, that is a product containing fractions of particles not larger than a predetermined size.

In view of the foregoing, the disintegrator according to the invention makes it possible to conveniently discharge the ground material in any direction to feed it either to the receiver 22 (FIG. 3), or to the separator 26 (FIG. 5), or to a conveyer belt (not shown). Accordingly, the disintegrator carries out either once-through grinding or separation grinding. Once-through grinding is advisable for obtaining end products with a wide grain size range, whereas separation grinding is preferable to produce a material with a narrow grain size range.

INDUSTRIAL APPLICABILITY

The invention can find application in laboratory equipment for conducting research in geology, in the production of construction materials, and in chemical engineering.

What is claimed is:

1. A disintegrator comprising a grinding chamber having grinding rotors accommodated therein, a housing for said grinding chamber including a cylindrical portion with an outlet pipe for evacuating material from said grinding chamber, and two side walls of said housing each mounted on opposite sides of said cylindrical portion, one of said two side walls having secured thereto a pipe for charging initial material to said grinding chamber, said cylindrical portion being movable relative to said two side walls and locked in a predetermined position by locking means for one of a direct grinding operation and a separation grinding operation, said locking means being arranged about the periphery of said cylindrical portion and said locking means including a pressure plate secured on one of said two side walls by a bolt, one end of said pressure plate bearing on a projection provided on said one wall, and the other end of said pressure plate being received by an annular groove defined by the outer surface of said cylindrical portion.

* * * * *